US010249954B2

(12) United States Patent
Huang et al.

(10) Patent No.: US 10,249,954 B2
(45) Date of Patent: Apr. 2, 2019

(54) DIPOLE ANTENNA

(71) Applicant: ARCADYAN TECHNOLOGY CORPORATION, Hsinchu (TW)

(72) Inventors: Chih-Yung Huang, Taichung County (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 15/697,931

(22) Filed: Sep. 7, 2017

(65) Prior Publication Data

US 2019/0013586 A1 Jan. 10, 2019

(30) Foreign Application Priority Data

Jul. 4, 2017 (TW) ..... 106122431 A

(51) Int. Cl.

| | |
|---|---|
| ***H01Q 1/24*** | (2006.01) |
| ***H01Q 9/06*** | (2006.01) |
| ***H01Q 9/28*** | (2006.01) |
| ***H01Q 5/20*** | (2015.01) |
| ***H01Q 5/342*** | (2015.01) |
| ***H01Q 1/36*** | (2006.01) |
| ***H01Q 9/04*** | (2006.01) |
| *H01Q 1/22* | (2006.01) |
| *H01Q 1/38* | (2006.01) |

(52) U.S. Cl.

CPC ..... *H01Q 9/065* (2013.01); *H01Q 1/241* (2013.01); *H01Q 1/243* (2013.01); *H01Q 1/36* (2013.01); *H01Q 5/20* (2015.01); *H01Q 5/342* (2015.01); *H01Q 9/0407* (2013.01); *H01Q 9/285* (2013.01); *H01Q 1/2291* (2013.01); *H01Q 1/38* (2013.01)

(58) Field of Classification Search

CPC ..... H01Q 9/065; H01Q 9/0407; H01Q 1/241; H01Q 1/36; H01Q 5/342; H01Q 1/243; H01Q 5/20; H01Q 9/285

See application file for complete search history.

(56) References Cited

FOREIGN PATENT DOCUMENTS

| | | | | |
|---|---|---|---|---|
| EP | 2833475 A1 * | 2/2015 | ..... | H01Q 9/065 |
| JP | 2003309418 A * | 10/2003 | ..... | H01Q 9/28 |

* cited by examiner

*Primary Examiner* — Hoang V Nguyen

(74) *Attorney, Agent, or Firm* — Locke Lord LLP; Tim Tingkang Xia, Esq.

(57) ABSTRACT

A dipole antenna includes a substrate, a first region and a second region, which is used for frequency with wavelength λ. The substrate is flat rectangular and insulating material, which has a substrate width W which is at least 2.5 mm and a substrate length L. The substrate width W, the substrate length L and the wavelength λ complies with the formula: L/W=λ(±10%). The first region and the second region is conducting material, the first region is disposed on the substrate and shifting to one side of the substrate, the second region is disposed on the substrate and shifting to another side of the substrate. Part of the first region is disposed adjacent to part of the second region and an adjacent region is formed between and a coupling effect is reduced.

6 Claims, 5 Drawing Sheets

DIPOLE ANTENNA

CROSS REFERENCE TO RELATED APPLICATION

This application also claims priority to Taiwan Patent Application No. 106122431 filed in the Taiwan Patent Office on Jul. 4, 2017, the entire content of which is incorporated herein by reference.

FIELD OF THE INVENTION

The present invention generally relates to a dipole antenna, and particularly, to a slim dipole printed antenna.

BACKGROUND OF THE INVENTION

With the advance of the technology, mobile electronic devices have become indispensable products for most people. As mobile electronic devices become more and more compact than before, various antennas with different sizes and functions are developed in order to conform to the requirements of various mobile electronic devices (e.g. mobile phone, notebook, etc.) and wireless transmission devices (e.g. wireless access point, wireless network card, etc.). Several kinds of antennas have been comprehensively applied to mobile electronic devices, such as the planar inverse-F antenna (PIFA), the monopole antenna or the dipole antenna because these antennas have compact size, good transmission performance and can be easily installed on the inner wall of a mobile electronic device.

However, the conventional dipole antennas still have a lot of shortcomings to be overcome. For example, as the width of most conventional dipole antennas is wide in comparison, it may take up too many space available in an antenna structure, and thus the conventional dipole antennas may not be suitable to be used in the modern electronic devices that are becoming smaller and smaller.

Therefore, it has been an important issue to provide a dipole antenna with a width to be formed as narrow as possible.

SUMMARY OF THE INVENTION

In an embodiment of the present invention, a dipole antenna is disclosed, which is adapted for applications using frequency with wavelength λ, and the dipole antenna comprises:

a substrate, being formed as a flat rectangular with a width W of at least 2.5 mm and a length L according to the formula: $L/W=\lambda(\pm 10\%)$, while being made of an insulating material;

a first region, made of a conducting material and being disposed on the substrate at an offset location neighboring to a side of the substrate; and a second region, made of a conducting material and being disposed on the substrate at an offset location neighboring to another side of the substrate that is corresponding to the first region;

wherein, an adjacent region is defined using a potion of the first region and a portion of the second region that are disposed neighboring to each other and is used for enabling a coupling effect, and the portion of the first region in the adjacent region is spaced from the portion of the second region in the adjacent region by an interval G.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
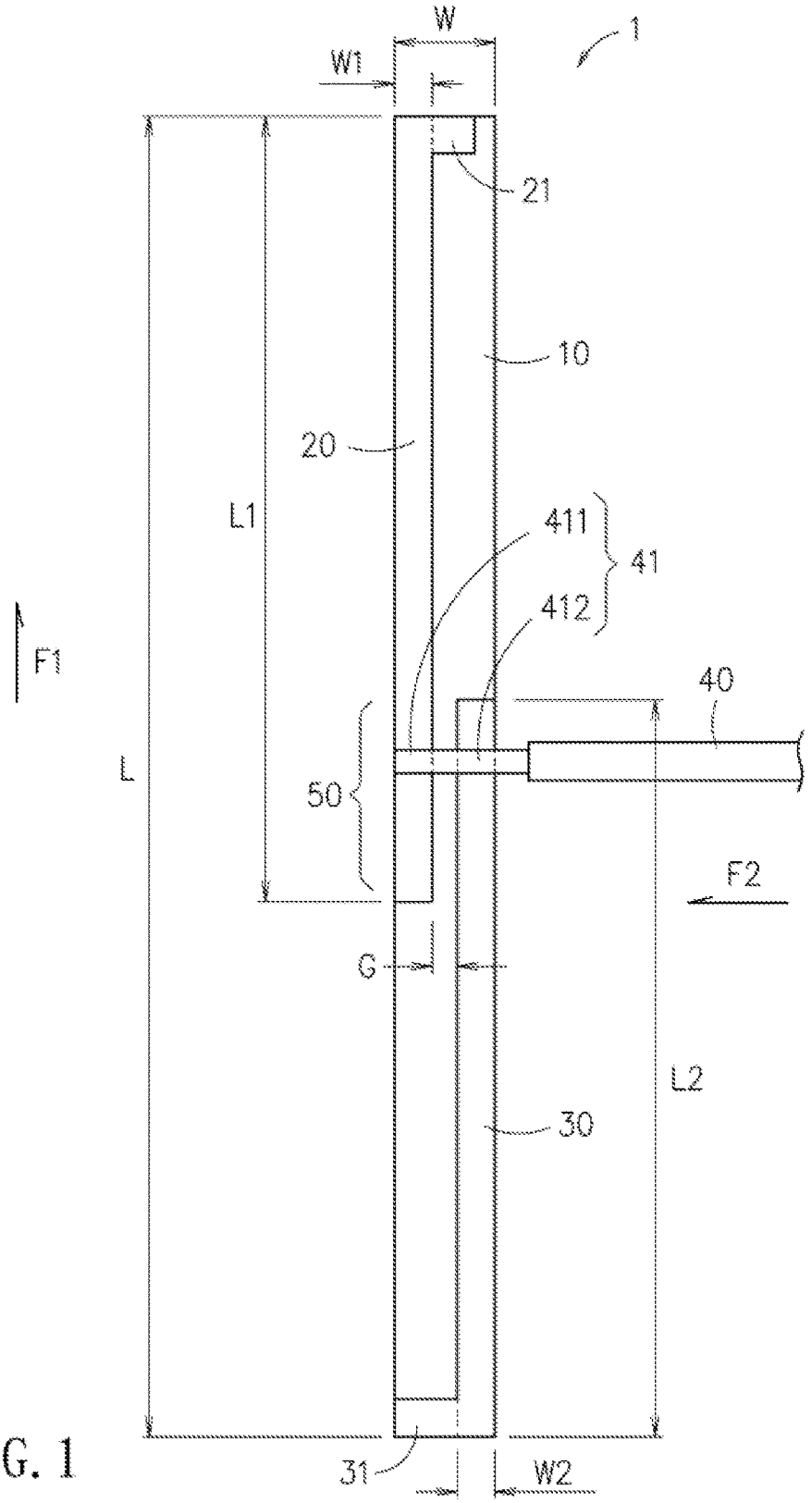
FIG. 1 is a schematic diagram showing a dipole antenna according to an embodiment of the present invention.

In the embodiment shown in FIG. 1, a dipole antenna 1 is disclosed, which is adapted for applications using frequency with wavelength λ, and the dipole antenna 1 has a substrate 10 with a first region 20 and a second region 30, whereas the substrate 10 is made of an insulating material while the first region and the second region 30 are made of conducting materials and are formed on a surface of the substrate 10 by printing.

In addition, the substrate 10 is formed as a flat rectangular with a width W of at least 2.5 mm and a length L according to the formula: $L/W=\lambda(\pm 10\%)$, while enabling the length direction along the length L of the substrate to be arranged parallel to a first direction F1, and the width W of the substrate to be at least 2.5 mm.

In the embodiment shown in FIG. 1, the first region 20 is formed as a long strip with a first length L1 and a first width W1, and the first region 20 is disposed on the substrate 10 while enabling the length direction of the first length of the first region 20 to be disposed parallel to the length direction of the substrate 10, i.e. parallel to the first direction F1, while being disposed on the substrate 10 at an offset location neighboring to a side of the substrate 10; and similarly, the second region 30 is also formed as a long strip with a second length L2 and a second width W2, and the second region 30 is disposed on the substrate 10 while enabling the length direction of the second length F2 of the second region 30 to be disposed parallel to the length direction of the substrate 10, i.e. parallel to the first direction F1, while being disposed on the substrate 10 at an offset location neighboring to another side of the substrate 10 that is corresponding to the first region 20. Furthermore, an adjacent region 50 is defined using a portion of the first region 20 and a portion of the second region 30 that are disposed parallel to the first direction F1 in length while extending as long as those portions are disposed neighboring to each other for enabling a coupling effect, and the portion of the first region 20 in the adjacent region 50 is spaced from the portion of the second region 30 in the adjacent region 50 by an interval G, whereas the interval G is formed conforming to the following formula:

$$G \leq 0.25W.$$

Moreover, the first region 20 is welded to an end 411 of a welding section 41 formed on a signal line 40, and the second region 30 is welded to another end 412 of the welding section 41, while the welding section 41 is arranged straddling across the interval G, i.e. the welding section 41 is arranged straddling across the adjacent region 50. In an embodiment, the end of the signal line 40 that is connected to the second region 30 is further connected to a signal module, whereas the signal module can be a RF module.

In this embodiment, since the adjacent region 50 is defined in a direction parallel to the length directions of the first region 20 and the second region 30, the welding section 41 of the signal line 40 can be arranged extending along a second direction F2 that is perpendicular to the first direction F1, and thus straddling across the interval G, while enabling the opposite ends 411, 412 thereof to be welded to the first region 20 and the second region 30 in respective.

Figure 2:
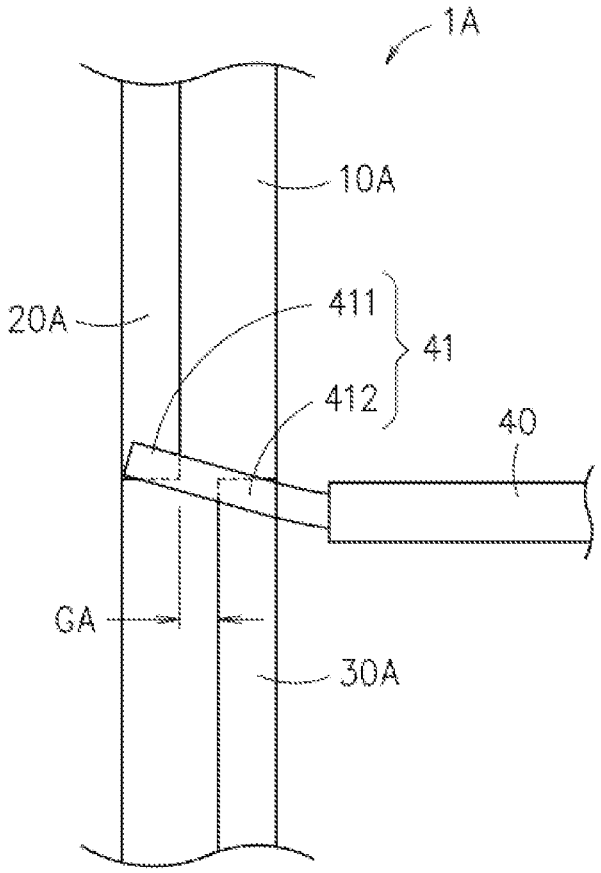
FIG. 2 is an enlarged view of the dipole antenna if FIG. 1 that is formed without an adjacent region.

Operationally, the adjacent region 50 can be used for adjusting the impedance matching of the dipole antenna 1. It is noted that the defining of the adjacent region 50 in area is not finite nor is not necessary, and thus the formation as well as the connection of the welding section 41 to the first and the second regions 20, 30 is not limited to the manner shown in FIG. 1. As another embodiment shown in FIG. 2, the dipole antenna 1A is also formed with a first region 20A and a second region 30A, but is different in that: in this embodiment, the top of the first region 20A is tangent to the top of the second region 30A, and thus there is no adjacent region to be formed in the embodiment shown in FIG. 2; and consequently, in stead of perpendicularly, the welding section 41 of the signal line 40 is slantingly straddling across the interval GA to be connected to the first region 20A and the second region 30A by the two ends 411, 412 thereof in respective.

As shown in FIG. 1, the two ends of the substrate 10 in the length direction F1 are formed respectively with a first extension region 21 and a second extension region 3, and the first and the second extension regions 21, 31 are made respectively of a conducting material in a manner that the first extension region 21 is connected to the first region 20 and the second extension region 31 is connected to the second region 30. The formation of the first and the second extension regions 21, 31 are used for prolonging the length of the first and the second regions 20, 30. However, in actual practice, there can be no such first and the second extension regions 21, 31 to be formed in the dipole antenna of the present invention.

Figure 3:
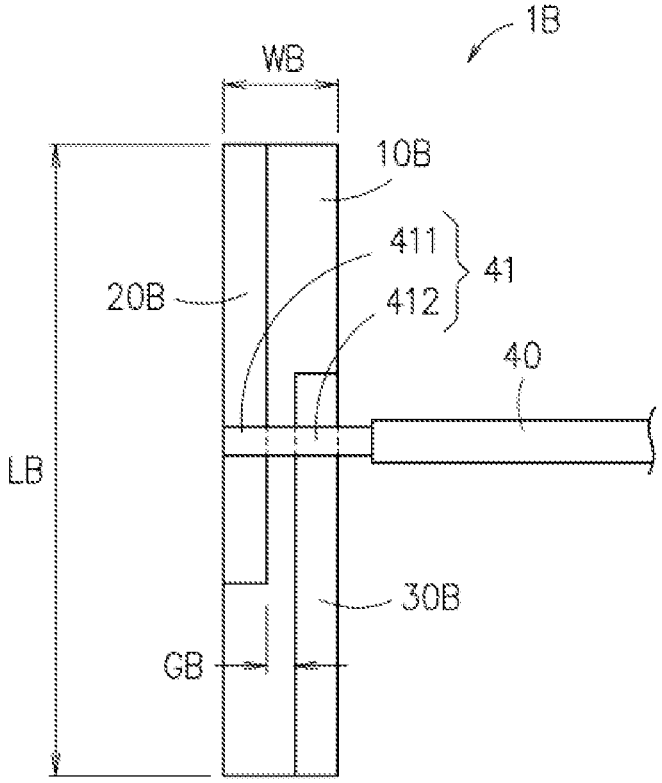
FIG. 3 is a schematic diagram showing a dipole antenna according to another embodiment of the present invention.

In another embodiment shown in FIG. 3, a dipole antenna 1B is disclosed, which is adapted for applications using frequency with wavelength λB, and the dipole antenna 1B has a substrate 10B with a first region 20B and a second region 30B. Similarly, the substrate 10B is formed as a flat rectangular with a width WB and a length LB according to the formula: LB/WB=λB(±10%).

In the embodiment shown in FIG. 3, the first and the second regions 10B, 20B are both formed as a long strip while similarly enabling a interval GB to be formed spacing between the neighboring sides of the first and the second regions 10B, 20B in their length directions parallel to the length direction of the substrate 10B; whereas the interval GB is formed conforming to the following formula:

$$GB \leq 0.25WB.$$

Thereby, the welding section 41 of the signal line 40 is arranged straddling across the interval GB, while allowing the opposite ends 411, 412 to be welded respectively to the first region 20B and the second region 30B. Nevertheless, the first region 20B and the second region 30B can also be formed as those shown in the FIG. 2, i.e. the top of the first region 20B can be arranged tangent to the top of the second region 30B as the first and the second regions 20A, 30A shown in FIG. 2.

As shown in FIG. 1, operationally, the dipole antenna of the invention is designed to use the end 411 of the welding section that is connected to the first region 20 as its signal feeding terminal while allowing another end 412 of the welding section 41 that is connected to the second region 30 to be used as its ground terminal. Thereby, the portion of the welding section 41 that is arranged straddling across the interval G can act as an isolation layer between the signal feeding terminal and the ground terminal.

When the embodiment of FIG. 1 is applied in an application using a frequency of 2450 MHz with a wavelength of 12.2 cm, its substrate 10 will be designed with a length L of 46 mm and a width W of 3.5 mm according to the formula:

$$L/W=\lambda(\pm 10\%).$$

Figure 4:
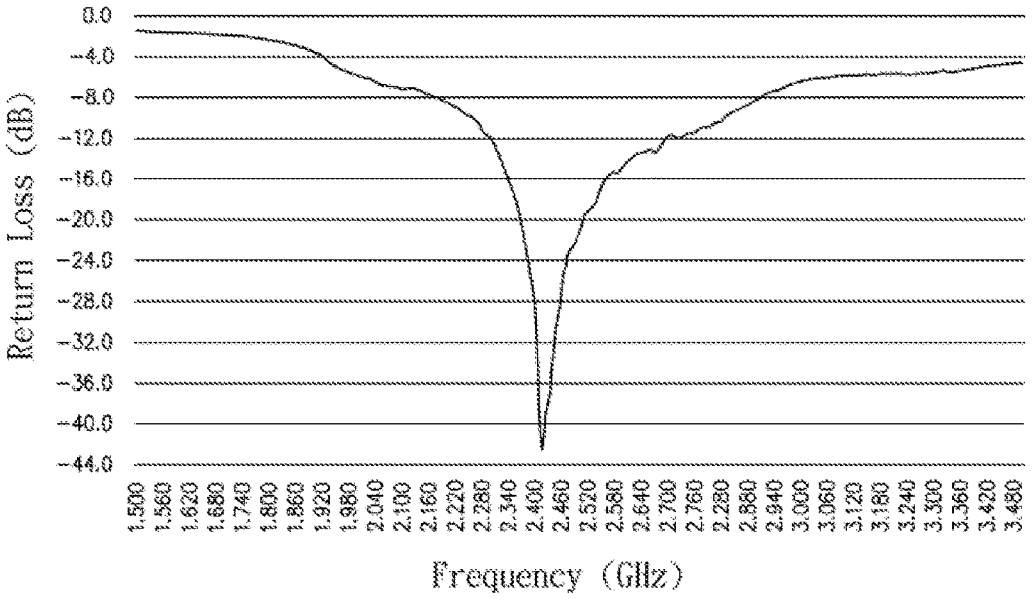
FIG. 4 is a diagram showing the return loss of FIG. 1.
Figure 5:
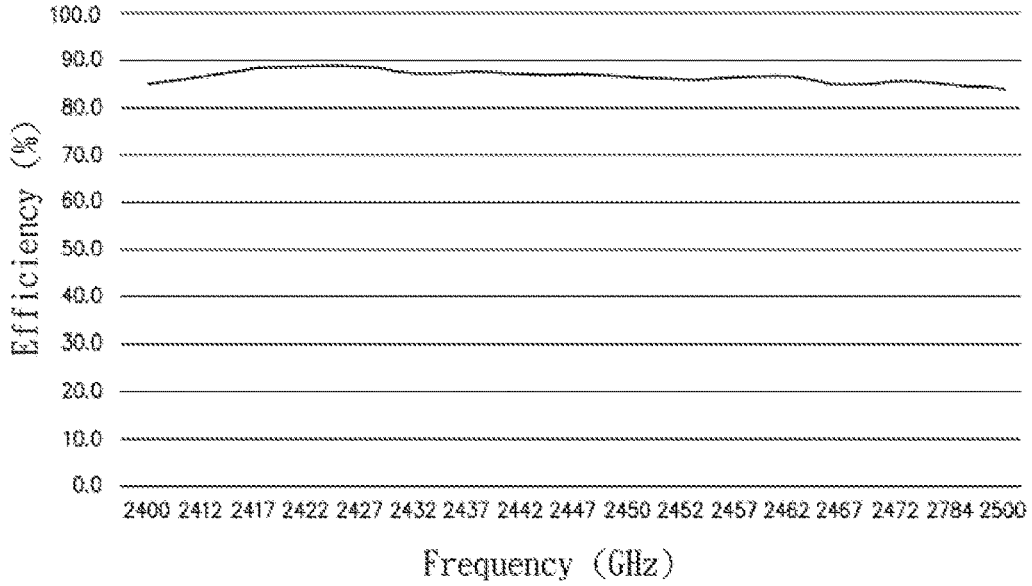
FIG. 5 is a diagram showing the radiation efficiency of FIG. 1.

Please refer to FIG. 4 and FIG. 5, which are diagrams showing the return loss and radiation efficiency of FIG. 1, Thereby, the dipole antenna 1 of FIG. 1 is proven to be able to achieve a desirable effect as expected.

When the embodiment of FIG. 3 is applied in an application using a frequency of 5000 MHz with a wavelength of 6 cm, its substrate 10B will be designed with a length LB of 20 mm and a width WB of 3.6 mm according to the formula:

$$LB/WB=\lambda B(\pm 10\%).$$

Figure 6:
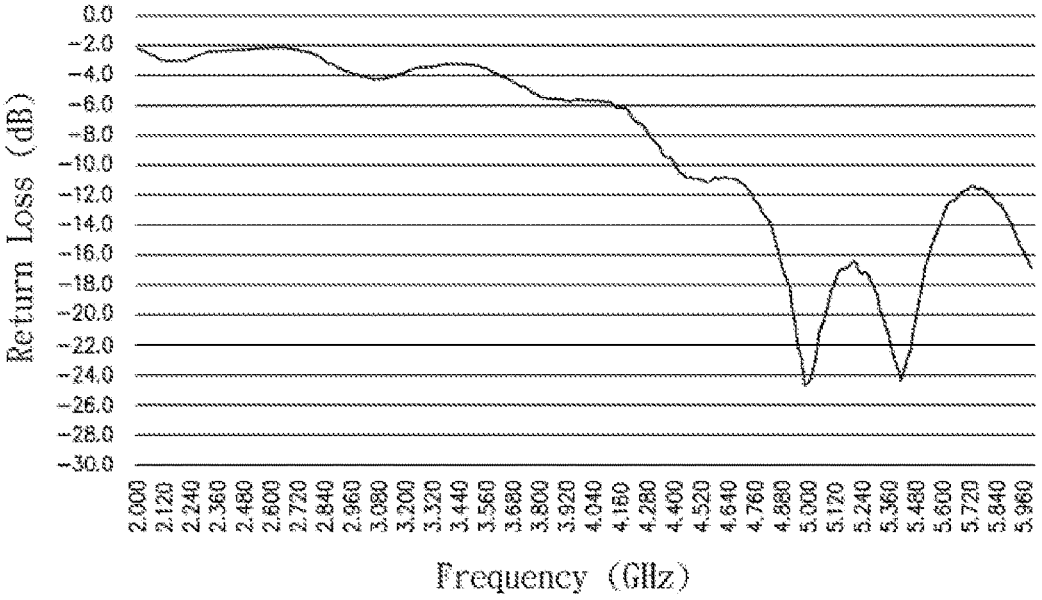
FIG. 6 is a diagram showing the return loss of FIG. 3.
Figure 7:
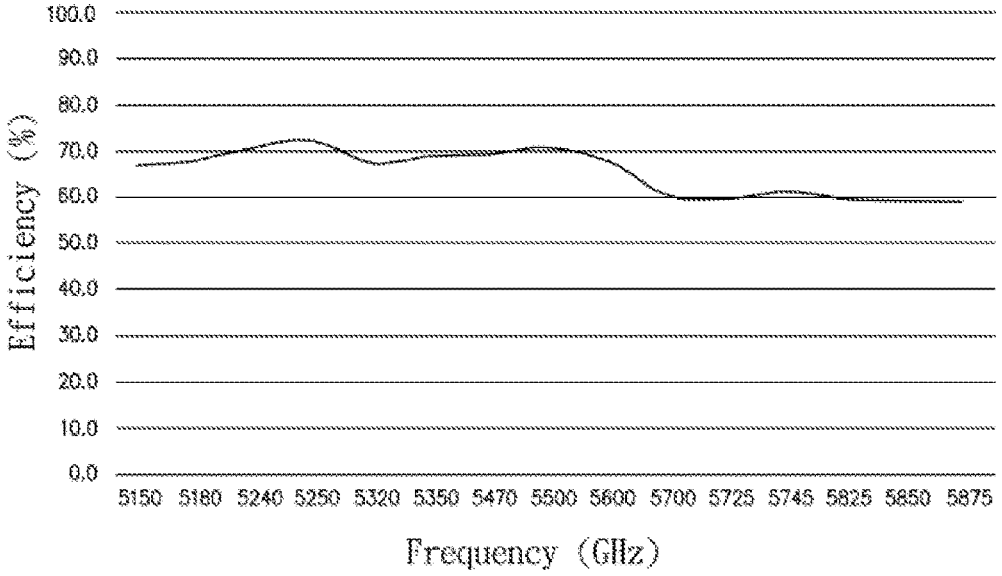
FIG. 7 is a diagram showing the radiation efficiency of FIG. 3.

Please refer to FIG. 6 and FIG. 7, which are diagrams showing the return loss and radiation efficiency of FIG. 1, Thereby, the dipole antenna 1B of FIG. 3 is proven to be able to achieve a desirable effect as expected.

In both the embodiments shown in FIG. 1 and FIG. 3, the size of the substrates being used are reduced by about 50%, comparing to the conventional dipole antennas of the same operating frequency. In addition, as disclosed in the above description, theoretically the width of the substrate can be reduced to at least 2.5 mm, so that the substrate width of 3.5 mm or 3.6 mm using in the dipole antennas as those shown in FIG. 1 and FIG. 3 can be reduced if required.

To sum up, the dipole antenna of the present invention can be adapted for applications of various frequencies by adjusting its length to cape with its comparatively narrow width, so that it is a printed antenna whose operating frequency can be easily adjusted by design. As the with of the dipole antenna of the present invention is reduced by about 50% comparing to those conventional dipole antennas, its material cost is reduced significantly by the antenna width reduction while without affecting to its desired antenna characteristics. Consequently, the dipole antenna of the present invention can be easily fitted into various modern multi-antenna systems that are generally designed with limited space.

Since the dipole antenna of the present invention is designed to operate independently, that is, it can operate independently without additional ground terminal that is essential for conventional antennas, the dipole antenna of the present invention can be disposed in any random position that is available in the system without being restricted by the accessibility to the system grounding.

Besides, the design of the present invention can be implemented by a printed antenna, so the antenna can be manufacturing without using molds and without assembly process; accordingly, the cost of the antenna can be significantly reduced to increase its product competitiveness.

In addition, for the current electronic products that are generally manufactured under low gross profit and are required to operate wirelessly under all kinds of environmental conditions, the dipoles antenna of the present invention is advantageous for its capable of being adapted easily for different applications in different systems as it is designed to operate independently and can be installed on any inner wall of various systems.

Respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A dipole antenna, adapted for applications using frequency with wavelength λ, comprising:

a substrate, being formed as a flat rectangular with a width W of at least 2.5 mm and a length L according to the formula: $L/W=\lambda(\pm 10\%)$, while being made of an insulating material;

a first region, made of a conducting material and being disposed on the substrate at an offset location neighboring to a side of the substrate; and a second region, made of a conducting material and being disposed on the substrate at an offset location neighboring to another side of the substrate that is corresponding to the first region;

wherein, an adjacent region is defined using a portion of the first region and a portion of the second region that are disposed neighboring to each other and is used for enabling a coupling effect, and the portion of the first region in the adjacent region is spaced from the portion of the second region in the adjacent region by an interval G, wherein the longitudinal sides of the portion of the first and the second regions that are arranged parallel to the length direction of the substrate of the length L are disposed spacing from each other by an interval G, while enabling the interval G to be formed conforming to the following formula:

$$G \leq 0.25W.$$

2. The dipole antenna of claim 1, wherein the first region is formed as a long strip with a first length and a first width, and the first region is disposed on the substrate while enabling the length direction of the first length of the first region to be disposed parallel to the length direction of the substrate; and the second region is formed as a long strip with a second length and a second width, and the second region is disposed on the substrate while enabling the length direction of the second length of the second region to be disposed parallel to the length direction of the substrate.

3. The dipole antenna of claim 2, wherein the two ends of the substrate in the length direction are formed respectively with a first extension region and a second extension region, and the first and the second extension regions are made respectively of a conducting material in a manner that the first extension region is connected to the first region and the second extension region is connected to the second region.

4. The dipole antenna of claim 1, wherein the first region is welded to an end of a welding section formed on a signal line, and the second region is welded to another end of the welding section, while the welding section is arranged straddling across the interval G.

5. The dipole antenna of claim 4, wherein the end of the signal line that is connected to the second region is further connected to a signal module.

6. The dipole antenna of claim 4, wherein the welding section is arranged straddling across the adjacent region.

* * * * *